United States Patent [19]

Reinhold

[11] 4,191,342

[45] Mar. 4, 1980

[54] ADJUSTABLE ROLL MANDREL

[76] Inventor: Ronald W. Reinhold, 4426 Buttercup La., East, Traverse City, Mich. 49684

[21] Appl. No.: 923,333

[22] Filed: Jul. 10, 1978

[51] Int. Cl.[2] ..... B65H 75/02

[52] U.S. Cl. ..... 242/68; 242/55.2; 242/68.5; 242/73

[58] Field of Search ..... 242/55.2, 55.53, 68, 242/68.4, 71.9, 73, 68.5; 160/263

[56] References Cited

U.S. PATENT DOCUMENTS

| | | | |
|---|---|---|---|
| 188,253 | 3/1877 | McKay | 242/68.4 |
| 3,081,960 | 3/1963 | Howe | 242/73 X |
| 3,099,916 | 8/1963 | Rosenbaum | 160/263 |
| 3,239,158 | 3/1966 | Levesque | 242/55.53 |

*Primary Examiner*—George F. Mautz
*Attorney, Agent, or Firm*—Glenn B. Morse

[57] ABSTRACT

A roll mandrel has a tubular center section and a plunger slidable in each end, each of the plungers having a plurality of journal sections of different diameters. The plungers are slidable to adapt the mandrel to a variety of spaced brackets that may have different bearing section diameters, at least one of which is radially open. The plungers are held in adjustable axial position by the friction of O rings against the inside of the central tube.

3 Claims, 3 Drawing Figures

ADJUSTABLE ROLL MANDREL

BACKGROUND OF THE INVENTION

Roll-supporting mandrels of variable length are standard items in a number of installations. Most of these devices have telescoping components that are spring-biased to increase length for insertion and removal from support brackets that have peripherally-closed bearing sections. In other words, insertion into the bracket requires a shortening of the mandrel against the action of an internal compression spring to a sufficient degree to permit insertion between the brackets, followed by axial extension by the spring as the unit snaps into the bearing recesses in the brackets. Probably the most common application of such a device is in the toilet roll bracket.

A quite different type of application for a variable-length mandrel is found in the support of a roll of paper in a calculating machine. In this case, one or both of the spaced bracket sections have a radially-open bearing permitting the mandrel to be lifted out directly, rather than shortened for axial withdrawal from the bearing recesses. The standardization of the width of the paper rolls results in a corresponding approximate standardization of the spacing between the bracket sections, but each manufacturer tends to prefer its own selected bearing diameter. The removable mandrels tend to be lost over the periods of use of the calculating machines, and suppliers and service personnel have found it necessary to stock a wide assortment of such mandrels in order to supply the needs of the users of the machines made by the various manufacturers. The usual spring-loaded mandrel of the type common in conjunction with toilet roll brackets is not convenient in the calculating machine application, for a number of reasons. One of these is that it is undesirable to have a continuing end thrust operating on the support brackets of the calculator, as many of these are merely relatively thin-walled structures of molded plastic material which exhibit a tendency toward deformation under continued pressure. The standard form of the spring-loaded mandrel would also serve no particular purpose, as no provision is made for accommodating the mandrel to varying diameters of the bearing sections that are in common use. In the calculator application, there is no particular advantage to a variable axial length except to engage different journal diameters, as the spacing between the bracket sections is fairly standard.

SUMMARY OF THE INVENTION

A roll mandrel is constructed to accommodate a variety of bearing sections that have relatively standard spacing, at least one of which is radially open to permit lateral withdrawal of the mandrel from the brackets. The mandrel has a tubular center section, and a pair of plungers which are equipped with a series of coaxial bearing sections of different diameters, and which are intended to project axially beyond the ends of the central tube. These plungers are equipped with O rings for generating a resistance to axial movement such as will maintain an adjusted length of the entire mandrel, which is selected to engage the particular journal diameter appropriate to the bearing sections of a particular machine. The central portion of the tubular section has an opening to permit the escape of air resulting from adjusting the position of the plungers.

DESCRIPTION OF THE PREFERRED EMBODIMENT

Figure 1:
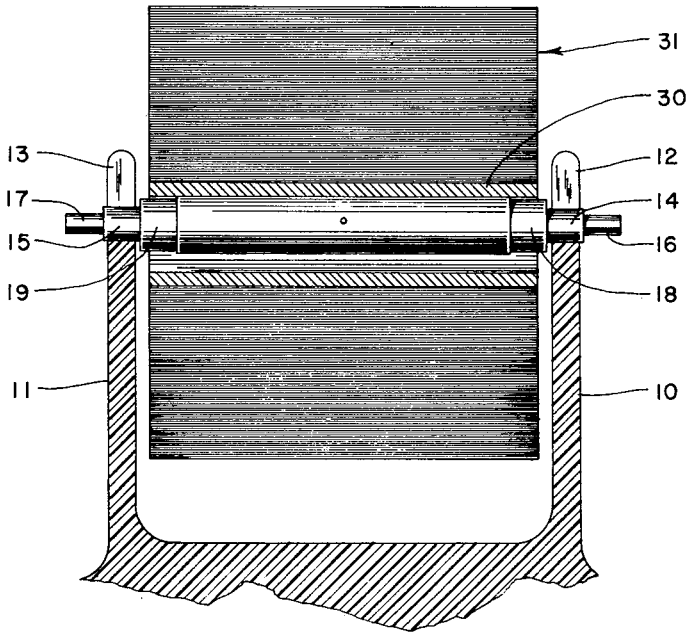
FIG. 1 is a sectional elevation showing the roll bracket of a conventional calculating machine, with a roll of paper in position as supported by the mandrel illustrated in FIGS. 2 and 3.

Referring to the drawing, the bracket sections indicated at 10 and 11 of a conventional calculating machine have U-shaped recesses as indicated at 12 and 13. These normally are vertically oriented, and are adapted to receive a roll mandrel having a journal section slightly less in diameter than the spacing of the bearing sections provided by the recesses 12 and 13. The illustrated adjustable mandrel is adapted to replace an original mandrel having end journals corresponding to the journal sections 14 and 15. The mandrel assembly could as easily accommodate bearing sections having diameters corresponding to that indicated at 16–17. The use of the journal sections 16 and 17 would be accompanied by axially shortening the entire assembly to the extent that these two sections would be axially spaced the same distance as the illustrated spacing of the sections 14 and 15.

Figure 2:
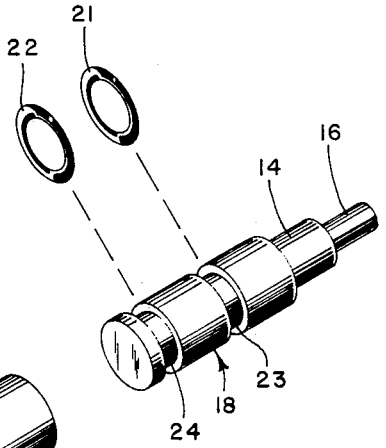
FIG. 2 is an exploded view showing the components of the adjustable mandrel.
Figure 3:
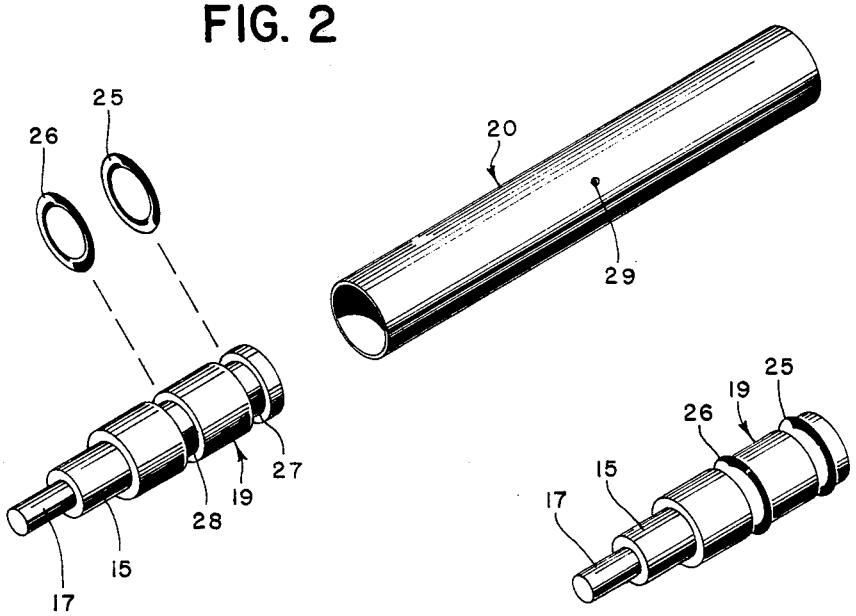
FIG. 3 is a perspective view showing one of the journal plungers, with the O rings assembled in position.

The structure of the mandrel assembly is indicated best in FIG. 2. The plungers 18 and 19 are slidably received within the central tube 20. The O rings 21 and 22 are respectively installed in the grooves 23 and 24 of the plunger 18, and the rings 25 and 26 in the grooves 27 and 28 of the plunger 19. The installation of the plungers can be facilitated by providing a small internal bevel in the ends of the tube 20. The function of these O rings is exclusively to establish a strong resistance to sliding movement of the plungers, so that the axial position of the plungers within the central tube 20 can be maintained. During such axial adjustment, it is obvious that the plungers will function as very efficient pistons, and a vent hole 29 is provided in the axially central portion of the tube 20 to permit the escape of any such compressed air, or the relief of vacuum. Either of these might tend to cause the pistons to shift in their adjusted positions.

As the mandrel assembly is adapted for engagement with a particular set of support brackets, the plungers 18 and 19 should be adjusted to produce the desired axial spacing of the appropriate journal sections, with substantially equal extension from the ends of the tube 20. The adjusted mandrel is then slipped through the core tube 30 of the paper roll 31, and this combination is simply dropped into the open bearing sections 12 and 13 of the brackets. The equalization of the projection of the plungers from the opposite ends of the central tube has a corresponding tendency to centralize the support of the weight of the paper roll 31, which might produce problems in feeding through the machine if a roll were supported eccentrically. Any such eccentricity of support would tend to move the paper roll to one side or the other, and drag on one of the support brackets to produce a resistance to the spooling action, and also to produce a possible tilt which might present a further problem in particular instances. The simplicity of the assembly illustrated in FIG. 2 makes it possible to produce all the components on standard mass-production machinery of the type commonly known as a screw machine. If an attempt were made to produce the effects of the plurality of journal sections 14–17 through the use of spring-loaded plungers, the insertion and removal of the mandrel and roll would be rendered more inconvenient, and would produce an obvious tendency to provide an eccentric support for the roll due to the unequal axial extensions of the bearings from the central tubular member. With a pair of loose plungers and a separate central tube, a resulting assembly would be difficult to maintain as an intregral unit during the replacement procedure, and would invite the loss of the components in the process, in addition to the fact that it would be almost impossible to maintain the centralized position of the central tubular member to provide a central support of the roll.

I claim:

1. A roll mandrel having a tubular central portion for supporting a roll of strip material, and two members having journal portions of reduced diameter at opposite ends respectively one of said members being axially moveable with respect to the other thereof within said tubular central portion, wherein the improvement comprises:

a tube constituting said tubular central portion, and having a hole in the wall thereof in an axially central position;

said members being a pair of plunger members each having one of said journal portions integral therewith, and slideably received in said tube, each of said plunger members having a plurality of different journal diameter sections; and resistance means interposed between said plunger members and said tube to maintain the adjusted axial position of said plunger members within said tube.

2. A mandrel as defined in claim 1, wherein said resistance means is at least one O-ring engaging each of said plunger members.

3. A mandrel as defined in claim 1, in combination with a pair of spaced brackets each having a bearing section, at least one of said bearing sections being radially open.

* * * * *